US006813852B1

(12) United States Patent
Uchikoshi

(10) Patent No.: US 6,813,852 B1
(45) Date of Patent: Nov. 9, 2004

(54) COVER FOR IRON-RECEIVING MEMBER

(75) Inventor: Mitsuyuki Uchikoshi, Tokyo (JP)

(73) Assignee: SanKousha Co., Ltd. (JP)

( * ) Notice: Subject to any disclaimer, the term of this patent is extended or adjusted under 35 U.S.C. 154(b) by 0 days.

(21) Appl. No.: 10/638,870

(22) Filed: Aug. 11, 2003

(51) Int. Cl.[7] ..... D06F 71/24; D06F 83/00
(52) U.S. Cl. ..... 38/66; 223/73
(58) Field of Search ..... 38/66, 14, 63, 38/54, 141, 140, 69, 108; 223/3, 52–52.6, 72, 73, 74

(56) References Cited

U.S. PATENT DOCUMENTS 2,314,498 A * 3/1943 Hoagland ..... 38/141
2,715,985 A * 8/1955 Holliman et al. ..... 223/73
2,715,986 A * 8/1955 Ebner ..... 223/73
3,417,905 A * 12/1968 Aloi ..... 223/74
3,568,900 A * 3/1971 Paris ..... 223/70
3,637,128 A * 1/1972 Blevens et al. ..... 223/73
5,675,918 A * 10/1997 Harrod et al. ..... 38/66

* cited by examiner

*Primary Examiner*—Ismael Izaguirre
(74) *Attorney, Agent, or Firm*—Andrus, Sceales, Starke & Sawall, LLP

(57) ABSTRACT

This invention relates to a cover of an iron receiving member arranged near a dummy in which a shirt is put on the dummy and a cuff of the shirt is inserted into and fitted to the cover. The product of this invention is formed into a bag shape to be fitted to the iron-receiving member and a fixing tool is provided with an opening-shaped port to be fixed to the iron-receiving member. The product of this invention is made such that the lower surface of the cover main body abutting against the lower side of the iron-receiving member is provided with a bag part in a form of pocket which is bulged with hot air supplied for the dummy into the sleeve for finishing in tension a tuck part of a sleeve.

5 Claims, 4 Drawing Sheets

COVER FOR IRON-RECEIVING MEMBER

BACKGROUND OF THE INVENTION

1. Field of the Invention

This invention relates to a cover for an iron-receiving member. More particularly, this invention relates to a cover applied in an iron-receiving member accepting a hot iron for pressing either a cuff of a shirts or a tuck part in a shirts presser for pressing the shirts with a pair of front and rear pair of press irons under a state in which the shirts is placed on the dummy.

2. Description of the Related Art

As already been described in the gazettes of U.S. Pat. Nos. 4,634,030 and 3,568,900, this type of iron-receiving member of a presser of the prior art is normally formed into a flat plate-like member in which a pad is overlapped on a metallic plate, for example.

Then, this prior art cover applied to the usual iron-receiving member is formed by a heat-resistant fabric such as polyester and the like to cover the iron-receiving member in such a way that it may have a durability even if the cover is depressed by the hot iron.

Further, in the case of this type of presser of the prior art, the hot iron is installed above the iron-receiving member. Accordingly, application of this prior art presser showed a problem that one tuck part of the sleeve arranged at the upper surface of the iron-receiving member was pressed with the hot iron and the other tuck part arranged at a lower side of the iron-receiving member was not pressed and the wrinkles at the other tuck part could not be removed.

In addition, it is normally found in this type of presser that when the sleeve is to be finished, either steam or hot air is blown from inside the dummy into the sleeve, the sleeve is bulged out with hot air and finished in tension. In this case, when the hot air supplied into the sleeve is leaked out directly through the sleeve, a temperature of surrounding atmosphere is rapidly increased to cause a work environment and a work atmosphere to be deteriorated. In addition, in this case, the heat energy of the hot air cannot be completely applied and the heat energy is lost, so that the sleeve cannot be finished in tension efficiently.

In view of the foregoing problems found in the prior art, the present invention has been proposed.

Accordingly, a technical problem of the present invention is to provide a cover for an iron-receiving member in which the tuck part arranged at a lower side of the iron-receiving member can be tensioned without applying any hot iron and the hot air is accumulated in the sleeve to prevent any thermal energy of the hot air from being lost, a rapid increasing in temperature of the work space is prevented and at the same time it is formed in such a way that a finished state of the sleeve can be improved.

SUMMARY OF THE INVENTION

As shown in FIG. 1 and the like, the present invention relates to a cover for an iron-receiving member arranged near a dummy on which a shirts is put and the cuff of the shirts is inserted into and fitted to the cover. The cover of the present invention is formed into a bag-shape so as to be fitted to the iron-receiving member and the opening type port is provided with a fitting tool to be fixed to the iron-receiving member. In addition, the present invention is made such that the lower surface of the cover main body abutting against the lower side of the iron-receiving member is provided with a pocket-like bag part bulged out by the hot air supplied from the dummy into the sleeve and for finishing in tension the tuck part of the sleeve.

In the case of the present invention, as the fixing tool, there is provided a stripe or a plane-like fastener and the like. This material is applicable because a size, a length and a shape or the like of the bag part can be properly selected. As a material quality of the bag part, either a fabric of synthetic fiber or a resin sheet and the like having a heat-resistant characteristic and a non-permeating characteristic, for example, can be applied.

Further, in the case of the present invention, it is preferable for the bag part to be formed such that a clearance between it and the lower surface of the cover main body is gradually selected short as it approaches from the opening part at the extremity end toward the bottom part, and this is formed into a substantial triangular shape as seen in its side elevational view.

Because, in this case, when the cuff of the shirts is inserted into and fitted to the iron-receiving member, it is possible to prevent the bag part from becoming a hindrance in an inserting and fitting operation. Further, in accordance with this arrangement, the bag part is bulged out in compliance with a bulging of the bag part and the tuck part is easily tensioned.

In addition, it is preferable in the present invention that a bottom part of the bag part is arranged at a position where is spaced apart a clearance from the port part to the portion having the cuff of the shirts arranged therein.

Because, in this case, only the tuck part can be finished in tension positively under a state in which the cuff is fixed rigidly by a clamping.

It is preferable in the present invention that a portion having a cuff of the shirts arranged therein is formed to have a high frictional resistance against the cuff.

Because, in this case, it is possible to prevent the cuff from being displaced in position and the cuff can be easily set to the cover. More practically, the present invention is accomplished by a method wherein a surface of the portion having the cuff of a shirts arranged therein is coated with resin showing a high frictional resistance, or a portion having the cuff arranged therein is formed by a fabric showing a high frictional resistance.

As the fabric showing a high frictional resistance, there is provided a fabric having a silicone resin coated at its surface. In this case, the product of the present invention can be formed easily and at a low cost.

As described above, in the present invention, the bag part in a form of pocket shape can receive hot air and the tuck part can be set in tension by the bag part bulged out with hot air.

Accordingly, applying of the present invention enables some wrinkles at the tuck part arranged at the lower side of the iron-receiving member to be removed with the bag part without installing the hot iron at the lower side of the iron-receiving member. Further, in the case of the present invention, it is possible to accumulate hot air in the sleeve with the bag part and perform an efficient transmittance of thermal energy of hot air. Accordingly, the present invention enables a loss of thermal energy of hot air to be prevented, enables a finished state of the cuff to be made superior, enables to prevent hot air from being released at once at the cuff and further prevent a rapid increasing in temperature at the work space.

DETAILED DESCRIPTION OF THE PREFERRED EMBODIMENT

Figure 1:
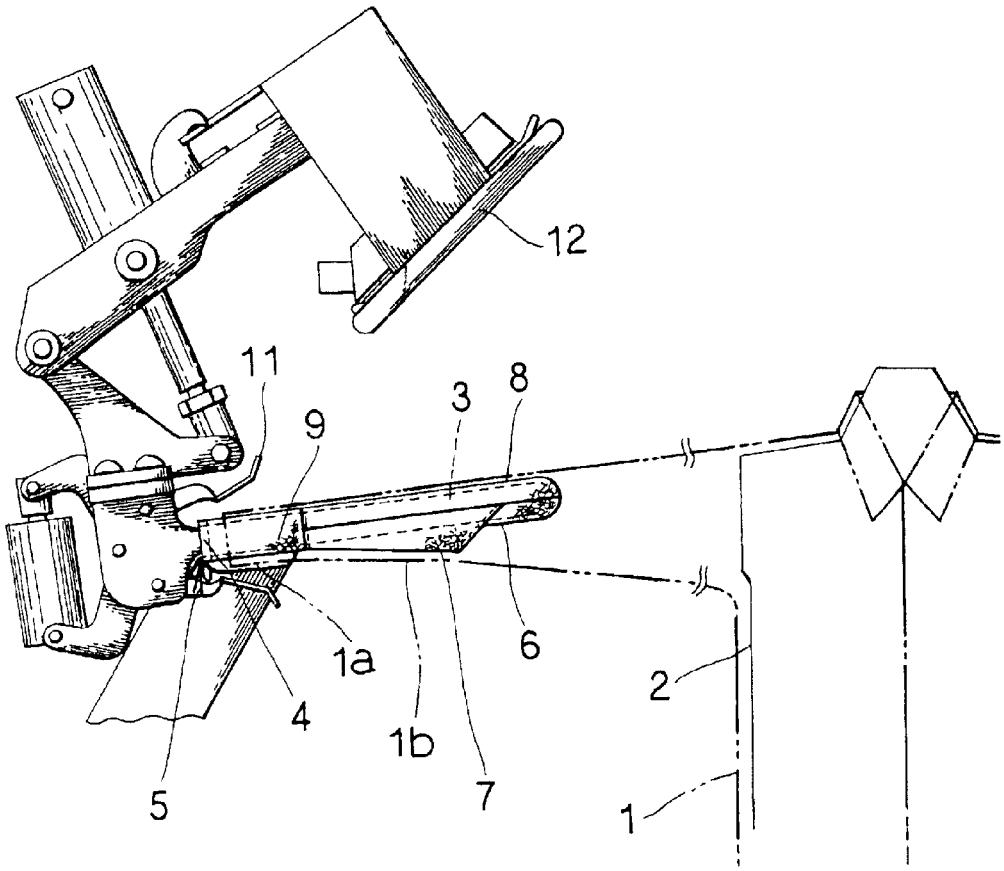
FIG. 1 is a substantial front elevational view with a part being broken way for showing one preferred embodiment of a cover of the present invention.

Referring now to the drawings, one preferred embodiment of the present invention will be described as follows.

Figure 2:
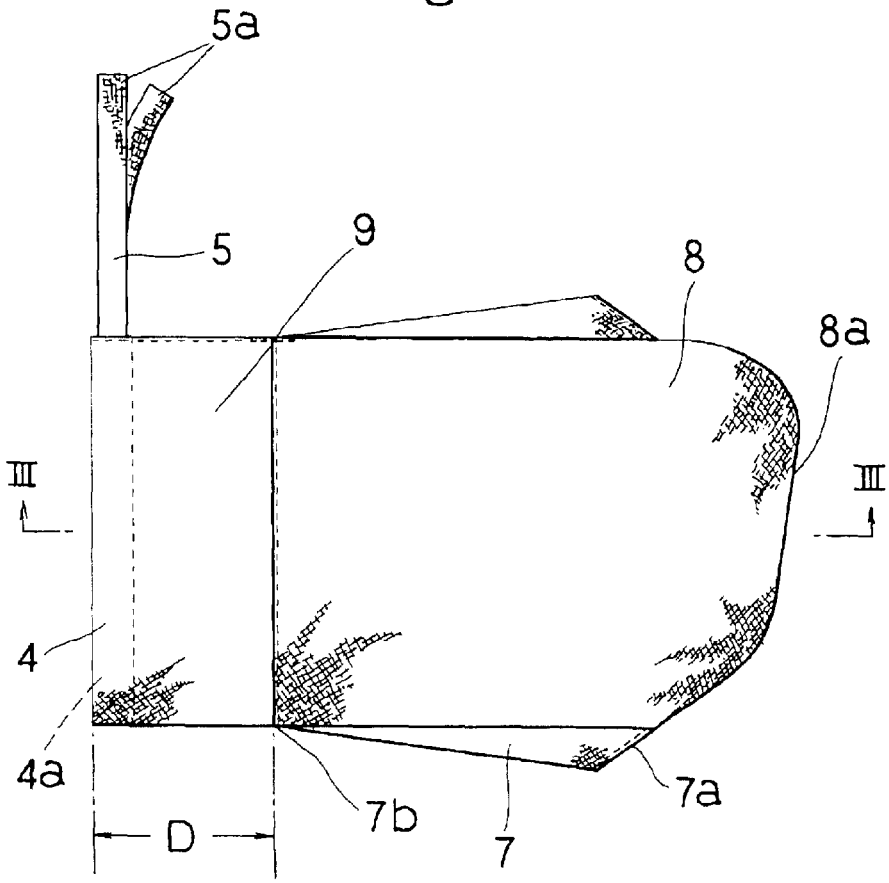
FIG. 2 is a top plan view for showing the cover of the present invention.
Figure 3:
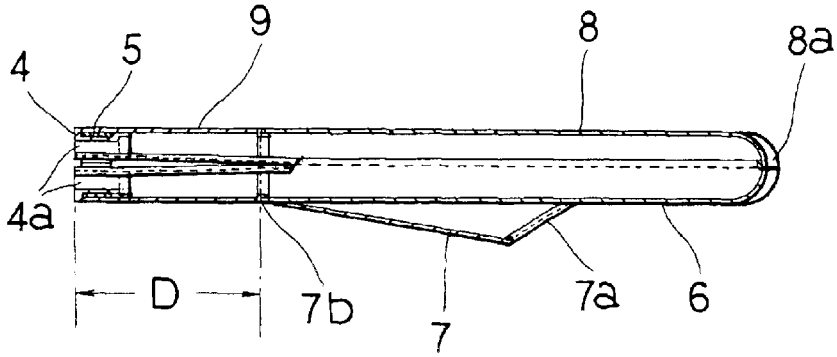
FIG. 3 is a sectional view taken along line III—III of FIG. 2.

In FIGS. 1 and 2 or the like, reference numeral 1 denotes a shirt such as a white shirts or the like and reference numeral 2 denotes a dummy onto which the shirts 1 is covered. Reference numeral 3 denotes an iron-receiving member arranged near the dummy 2 and into which a cuff 1*a* of the shirts 1 is inserted or fitted.

The present invention relates to a cover installed on the aforesaid iron-receiving member 3 and this cover is formed into a bag shape to be fitted to the iron-receiving member 3. In addition, the present invention is made such that a fitting tool 5 is provided with an opened port 4 to be fixed to the iron-receiving member 3. The fixing tool 5 in this preferred embodiment is a fine band-like stripe. In the case of the present invention, the aforesaid port 4 is folded back and formed to have a passage-like stripe passing part 4*a*, the fixing tool 5 is passed through this stripe passing part 4*a* and both ends 5*a* are pulled out of it.

In the present invention, a lower surface 6 of the cover main body 8 placed below the iron receiving member 3 is provided with a bag part 7 in a form off pocket bulged with hot air supplied from the dummy 2 into the cuff and for finishing in tension the tack part 1*b* of the cuff. The bag part 7 is selected such that a clearance with the lower surface 6 of the cover main body 8 is made gradually short as it is extended from an opening 7*a* at its extremity end to its bottom part 7*b*, and the bag part is formed into a substantial triangle shape as viewed from its side surface.

Figure 4:
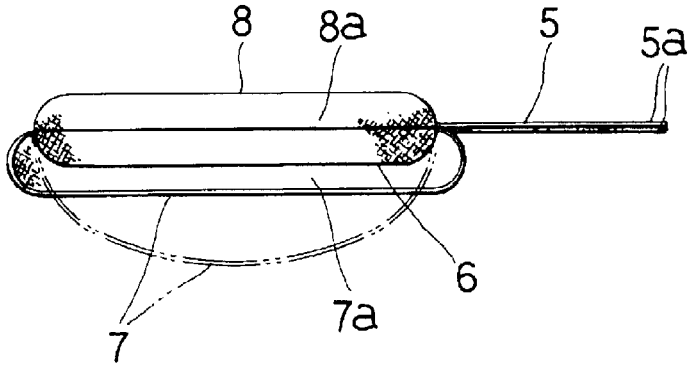
FIG. 4 is a front elevational view for showing the cover of the present invention.

The opening 7*a* of the bag part 7 is arranged to be displaced by a predetermined clearance at a side of the port 4 from an extremity end 8*a* of a cover main body 8 so as not to become a hindrance when the cuff 1*a* is fitted to the iron receiving member 3 and at the same time it is formed at the side of the port 4 in a downward inclined shape. As shown in FIGS. 2 and 4, the bag part 7 is made such that the opening 7*a* exceeds over a lateral width of the cover main body 8 so as to be formed as a wide lateral shape and further it is constituted with a certain surplus to enable it to be bulged out in a protruded curved shape at a lower side. In addition, a bottom part 7*b* of the bag part 7 is arranged with a space D (refer to FIG. 2 and the like) of a portion 9 having the cuff 1*a* of the shirts 1 arranged therein being spaced apart. Further, the bag part 7 is formed by fabric of synthetic fiber having heat-resistant characteristic and non-permeating characteristic such as polyester fiber and the like.

The portion 9 having the cuff 1*a* of the shirts 1 arranged therein in this preferred embodiment is formed by a fabric having silicon resin coated on its surface and the portion 9 is formed together with the cuff 1*a* under a high frictional resistance.

Next, an action of the present invention concerning this preferred embodiment will be described as follows.

Figure 6:
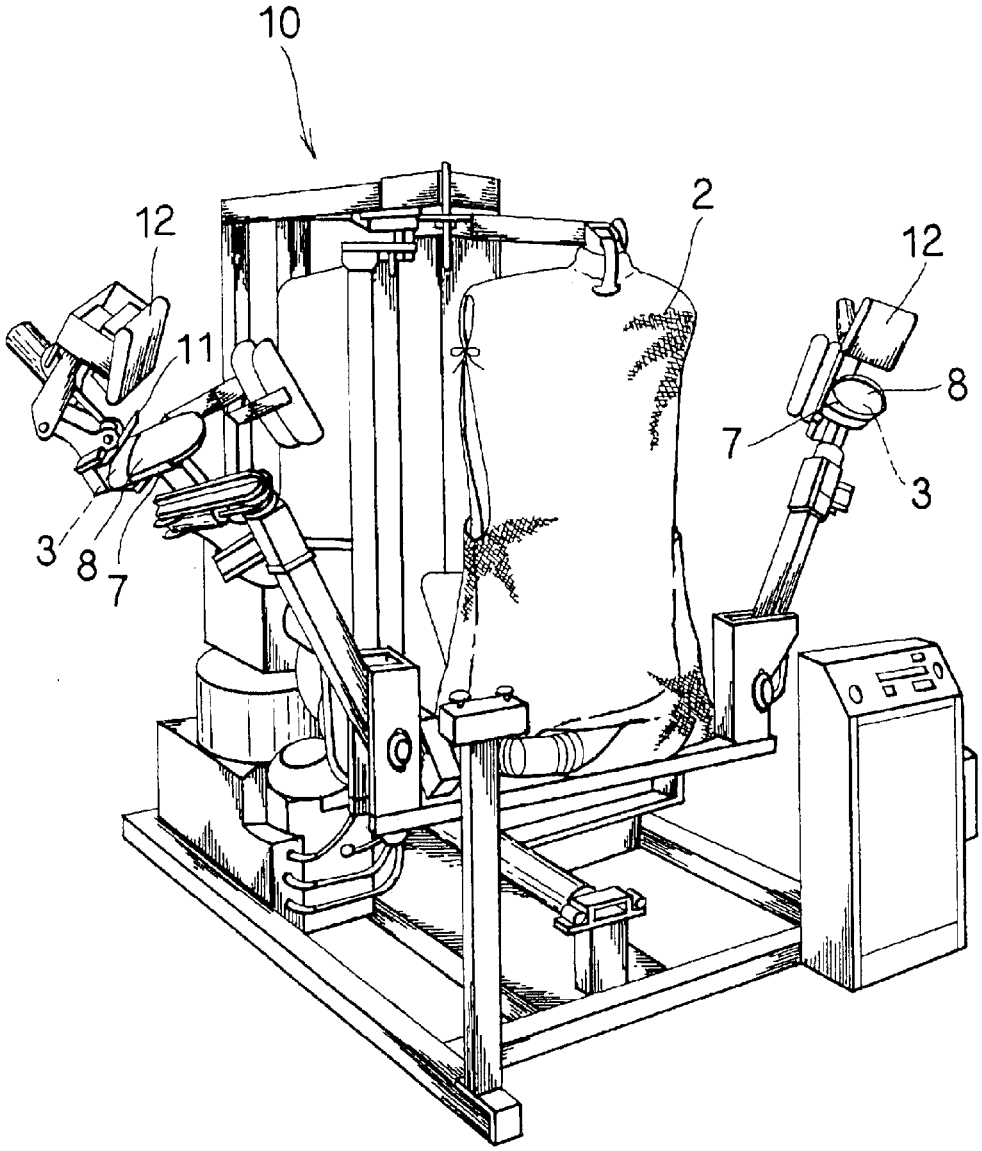
FIG. 6 is a perspective view for showing a shirts presser to indicate an applied state of the cover of the present invention.

As shown in FIGS. 1 and 6 or the like, the product of the present invention is inserted into and fitted to the iron-receiving member 3, bound at the root of the iron-receiving member 3 with a stripe acting as the fixing tool 5 and installed at the iron-receiving member 3. Under this state, a worker inserts and fits the cuff 1*a* of the shirts 1 into and to the iron-receiving member. In this case, the bag part 7 is formed into a substantial triangular shape as seen in its side elevational view as described above, the opening 7*a* is placed near the port 4 rather than the extremity end 8*a* of the cover main body 8 and further formed in a downward inclined shape. Accordingly, the cuff 1*a* is smoothly inserted into and fitted to the iron-receiving member 3 without being engaged with the bag part 7.

Figure 5:
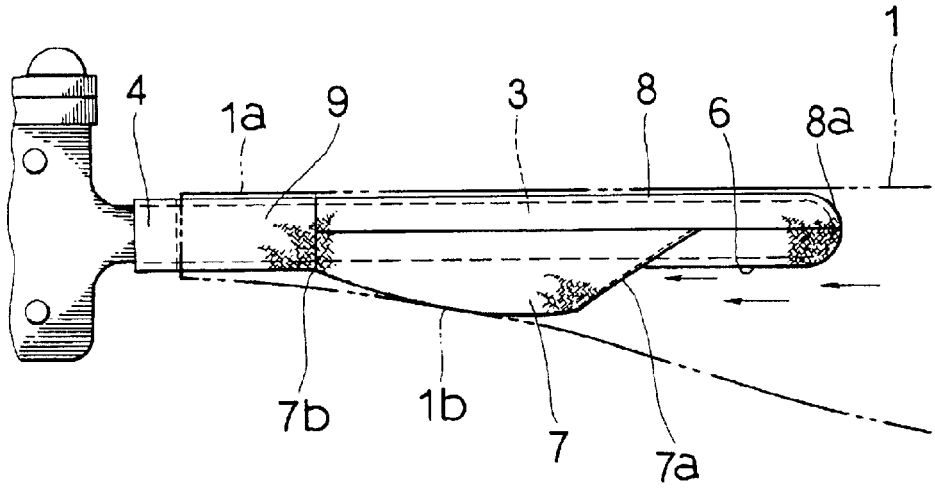
FIG. 5 is a substantial front elevational view with a part being broken way for illustrating an action of the cover of the present invention.

Next, the worker clamps the cuff 1*a* with a clamper 11 of the shirts presser 10 (refer to FIG. 6) and presses the tuck part 1*b* with the hot iron 12. When the hot air is fed into the sleeve from inside the dummy 2 under this state, the bag part 7 receives the hot air and bulges out as shown in FIG. 5. Then, in the case of the present invention, the tuck part 1*b* is finished in tension with the bag part 7. Then, in the case of the present invention, the hot air stops at the bag part 7 and is prevented from being leaked out at the extremity end of the sleeve.

What is claimed is:

1. A cover for an iron-receiving member arranged near a dummy on which a shirts is covered and into which a cuff of the shirts is inserted and fitted, wherein the cover is formed into a bag shape to be fitted to the iron-receiving member, a fixing tool is provided with an opening-shaped port to be fixed to the iron-receiving member, and the bag part bulged out with hot air supplied from a dummy into the sleeve and for finishing in tension a tuck part of a sleeve is arranged in a pocket-like manner at a lower surface of a cover main body abutting against a lower side of the iron-receiving member.

2. A cover for an iron-receiving member according to claim 1, wherein the bag part is selected to have gradually a short clearance between it and the lower surface of the cover main body, as it approaches from the opening part at the extremity end to the bottom part, and this is formed into a substantial triangular shape as seen in its side elevational view.

3. A cover for an iron-receiving member according to claim 2, wherein the bottom part of the bag part is arranged at a position where is spaced apart a clearance from the port part to a portion having the cuff of the shirts arranged therein.

4. A cover for an iron-receiving member according to claim 3, wherein a portion having the cuff of the shirts arranged therein is formed to have a high frictional resistance against the cuff.

5. A cover for an iron-receiving member according to claim 4, wherein a portion of the cover where the cuff of a shirts is arranged is formed by a fabric having a silicon resin coated at its surface.

* * * * *